US007790282B2

(12) United States Patent
Nadkarni et al.

(10) Patent No.: US 7,790,282 B2
(45) Date of Patent: Sep. 7, 2010

(54) SELF-CRIMPING FULLY DRAWN HIGH BULKY YARNS AND METHOD OF PRODUCING THEREOF

(75) Inventors: Vikas Madhusudan Nadkarni, Pune (IN); Santosh Raghavendra Huilgol, Thane (IN); Rajiv Kumar, New Mumbai (IN)

(73) Assignee: Reliance Industries, Ltd., Raigad District (IN)

( * ) Notice: Subject to any disclaimer, the term of this patent is extended or adjusted under 35 U.S.C. 154(b) by 757 days.

(21) Appl. No.: 11/632,411

(22) PCT Filed: Jul. 14, 2005

(86) PCT No.: PCT/IN2005/000242

§ 371 (c)(1),
(2), (4) Date: Jan. 12, 2007

(87) PCT Pub. No.: WO2006/027794

PCT Pub. Date: Mar. 16, 2006

(65) Prior Publication Data

US 2007/0254153 A1 Nov. 1, 2007

(30) Foreign Application Priority Data

Jul. 16, 2004 (IN) ..... 766/MUM/2004

(51) Int. Cl.
*D02G 3/00* (2006.01)

(52) U.S. Cl. ..... 428/370; 428/373; 428/374; 442/199; 442/200

(58) Field of Classification Search ..... 428/370, 428/373, 374, 394; 442/199, 200
See application file for complete search history.

(56) References Cited

U.S. PATENT DOCUMENTS

| | | | | |
|---|---|---|---|---|
| 3,497,585 | A | 2/1970 | Chapman et al. | |
| 5,093,061 | A * | 3/1992 | Bromley et al. | 264/172.14 |
| 6,811,873 | B2 * | 11/2004 | Nadkarni | 428/370 |
| 6,855,422 | B2 | 2/2005 | Magill et al. | |
| 2003/0052436 | A1 | 3/2003 | Koyanagi et al. | |

* cited by examiner

*Primary Examiner*—N. Edwards
(74) *Attorney, Agent, or Firm*—Blank Rome LLP

(57) ABSTRACT

Self-crimping fully drawn high bulk yarns comprising fiber forming bicomponent filaments comprising two polymers having different crystallizability or differential orientation or combination thereof is disclosed herein. Further the present invention discloses a method for producing the self-crimping fully drawn high bulk yarns by single and two-stage process. The invention also discloses the fabric comprising the self-crimping fully drawn high bulk yarns.

10 Claims, No Drawings

SELF-CRIMPING FULLY DRAWN HIGH BULKY YARNS AND METHOD OF PRODUCING THEREOF

RELATED APPLICATION

This application is a national stage of PCT/IN2005/000242, which was published on Mar. 16, 2006, and which claims the benefit of priority to India Application No. 766/MUM/2004, filed Jul. 16, 2004.

FIELD OF THE INVENTION

The present invention relates to self-crimping fully drawn high bulk yarns comprising bicomponent filaments, which manifest self-crimping characteristics in as-drawn yarns.

The present invention also related to a method of producing the self-crimping fully drawn high bulk yarns.

BACKGROUND OF THE INVENTION

Development of self-crimping yarns for generating high bulk has been one of the active areas for producing differentiated products. The self-crimping yarns can be used directly in stretch fabrics where the high crimp level of the yarns allows higher stretch in the fabrics. The filaments thus produced would have longer lasting crimp as it is developed in-situ since the two polymeric components are integrally bonded in each individual filament.

Various approaches have been explored to get the self-crimping characteristics. These include different cross-sections and various bicomponent geometries, namely, side-by-side, eccentric sheath-core etc. By and large, putting the two polymeric components in a side-by-side combination is the most widely used method to produce high bulk filaments.

A prior art survey indicates use of different polyamides in pairs or also polyethylene terephthalate (PET) with chemically different polyesters, such as, polybutylene terephthalate (PBT) or cross-linked polyesters. In some studies both the components are chemically modified and then spun into bicomponent yarns thus rendering self-crimping effect on to the yarns. Others have used elastomers as one of the components to get the desired effect. More recently, polymers like poly(trimethylene terephthalate) (PTT) have been used with PET or PBT, etc. for achieving the bulk characteristics.

Another approach is to use differential cooling of filaments in the spin line for producing high bulk filaments using a single polymer. Moreover, most of the methods employed in the prior art involve a two-step process, which comprises LOY spinning followed by drawing/draw-texturing. The present invention is a one step process for producing high bulk fully drawn yarns (FDY) or a two step process for getting textured yarns.

Some researchers have also tried Poly(ethylene terephthalate) (PET) and poly(butylene terephthalate) (PBT) wherein the Poly(butylene terephthalate) was cross-linked. In one of the inventions in the past, the PET and PBT are spun on bicomponent machine but the process of manufacture involved online cold drawing of the filaments. Polyester essentially requires hot drawing so as to have long term dimensional stability. In another recent process, PET and PBT are spun in bicomponent fashion but again the method employed was a two-stage process.

French patent 1,486,035 discloses a composite polyester made up of poly(ethylene terephthalate) and poly(ethylene terephthalate) cross linked with trimethylol propane.

A side-by-side or eccentric sheath-core bicomponent fiber wherein each component comprises poly(trimethylene terephthalate) differing in intrinsic viscosity (IV) and wherein at least one of the components comprises styrene polymer dispersed throughout the poly(trimethylene terephthalate) by partially oriented yarn (POY) or fully drawn yarn FDY route is disclosed in U.S. Pat. No. 6,641,916.

Polyamide conjugate filaments are prepared by a spin-stretch process wherein two polyamides (e.g. two nylon 66 polymers) having different terminal velocity distances are melt spun to form filaments in which the polymers are arranged in an eccentric/side-by-side configuration along the length of the filaments. The filaments are then stretched in-line at a stretch ratio greater than 1.0 prior to their being collected with the processing conditions and polyamides being selected to provide filaments having a high level of high-load crimp and a low level of boiling water shrinkage which is disclosed in U.S. Pat. Nos. 4,601,949 and 4,740,339.

While, the present invention is primarily based on two homopolymers and a reference of faster crystallizing copolymer is given.

U.S. Pat. No. 6,548,429 discloses a polymer yarn comprising a bicomponent yarn and a second yarn combined to form a single yarn. The bicomponent yarn comprises two components, each comprising a fiber-forming polymer and each preferably having different shrinkages, which effectuate a bulking effect. This may be obtained either by using different polymers or using polymers having different relative viscosities.

The conjugate fibres based on PET, PBT and PTT are disclosed in U.S. Pat. No. 6,306,499. This essentially is a process in which spinning is carried out at 1200 mpm and drawn in a separate process. Spinning polyesters at 1200 meters per minute gives a yarn that is termed as a LOY, which will have less orientation and lower shelf life. However, the subject of present invention is either a one step process with PET and PBT or PET with PTT etc. wherein winding is carried out at significantly higher speeds i.e. 3500 to 4500 mpm. Alternatively the process can be a two-stage POY and textured process.

U.S. Pat. No. 6,153,138 and U.S. Pat. No. 4,740,339 patents disclose the use of different Nylon polymer having differential relative viscosity to get the self-crimping effect.

But the present invention is primarily based on polymers having different levels of crystallizability.

A melt-spinning process for producing self-crimping, nylon 66 carpet yarn at spinning speeds of, for example 4000 meters per minute is disclosed in U.S. Pat. No. 4,975,325. The process utilizes polymer having a relative viscosity (RV) of at least 50 and containing a sufficient amount of a chain branching agent.

U.S. Pat. No. 4,661,404 discloses the polyester filaments having a generally oblong, qudrolobal cross section are produced with periodic variations in thickness along the length of yarn and the yarn being capable of developing crimp when thermally treated in a relaxed state and having a crimp-to-shrinkage ratio of at least 0.25.

The combination of elastic component and an inelastic component is disclosed in U.S. Pat. No. 4,554,121 to produce latent self-crimping yarns. While in the present invention elastic component in the stretch fabrics have been replaced by bicomponent polyester filaments, which will have easy care and easy processing characteristics.

U.S. Pat. No. 4,405,686 discloses a stretchable crimped elastic yarn, which is prepared from composite components respectively comprising thermoplastic elastomer and nonelastomeric polyamide or polyester, and each of the individual constituents has a cross section of a compressed flat shape like a cocoon or oval.

Polyolefins and polyester combination has been disclosed in U.S. Pat. No. 4,424,258 for getting self-crimping yarns. The degree of adhesion between polyolefin and polyester is low thus the chances of boundary separation are good. Moreover polyolefins will give rise to dyeing problems. While the present invention basically makes use of two kinds of polyesters and hence the degree of adhesion will be high and dyeing is not an issue.

JP 2004277930 discloses process of producing self-crimping yarns by use of PET and PTT as two polymer components in Bicomponent yarn produced by way of spinneret modification. While the desired product attributes in the present invention is achieved without any spinneret modification.

WO2001053573 discloses making of PTT/PET bicomponent yarns by way of quench modification and drawing at high speeds of the order of 5500 m/min. While the present invention focuses use of standard commonly used hardware for producing the high bulk yarns.

U.S. Pat. No. 6,811,873 discloses the art of producing self-crimping fibres by bicomponent spinning technology. The self-crimping fibres reported here comprise poly(ethylene terephthalate) based fibres of differing molecular weight.

The use of PET and PBT bicomponent yarns are disclosed in U.S. Pat. No. 4,217,321 wherein PET and PBT were extruded in a side-by-side cross section and are cold drawn in an isolated zone. The yarn prepared by this reported process may not be thermally stable. While the present invention intends to provide thermally stable yarn by using a simple process which doesn't involve cold drawing or isolated zone.

A prior art survey indicates use of different polyamides in pairs or also PET with chemically different polyesters, such as, PBT or cross-linked polyesters (U.S. Pat. Nos. 4,186,168, 4,117,194).

As per prior art survey majority of the work is focused on polyamides and their copolymers. The approaches employed include polyamides with different melt viscosity levels, and use of thermoplastic elastomer as one of the components, besides polyamide or polyester (U.S. Pat. Nos. 6,015,618, 6,153,138, 5,972,502, 5,948,528 4,975,325, 4,740,339, 4,405,686, 4,271,233, etc).

In prior art, majority numbers of disclosures indicate use of thermal treatment for getting fully crimped yarns. In the prior art, polymers used to prepare fully crimped yarns are either poly(ethylene terephthalate) with or without chemical modification or along with different combination of polymers.

Thus the processes reported in the prior art to produce the high bulk yarn are a two stage process which is time consuming and uneconomical.

In prior art the focus was on modification of the standard bicomponent spinning hardware such as quench modification or draw zone modification which incurs additional capital cost.

The polymer combination used in the prior art for preparing high bulk yarns, polyester and polypropylene or polyester and nylon, have very little adhesion power and tend to split during spinning/drawing process or during subsequent cloth washings. Thus the stretch attributes may not be durable.

The polymer combination used in the prior art to prepare high bulk yarn comprises polypropylene, which may have dyeing problems.

The stretch attributes are required in fabrics for various end uses such as sportswear, suitings, swimwear, ladies blouses, shirtings etc. The stretch gets developed after heat treatment like boiling water shrinkage or it is latent in the yarn. The end use segments are divided into 'comfort stretch' wear and 'power stretch wear' fabrics. But the scope of manufacturing fabrics with desired stretch attributes is limited due to the cumbersome manufacturing process. There is need to develop a simple and industrially viable process to manufacture the self-crimping high bulk yarn which have durable stretch attributes.

The present invention discloses use of two viscoelastic fiber forming polymer components with different rates of crystallization, or differential orientation or combination thereof which leads to differential morphological characteristics when spun and drawn online in a side-by-side bicomponent geometry causing stretch attributes. By varying process conditions in spinning/drawing process one can generate controlled differential in crystallinity or orientation to achieve desired yarn characteristics so that the required attributes like stretch and bulk can be developed in the fabric form. The self-crimping high bulk yarns of the present invention have stretch attributes which are durable.

SUMMARY OF THE INVENTION

The present invention discloses self-crimping fully drawn high bulk yarns comprising fibre forming bicomponent filaments comprising two polymers having different crystallizability or differential orientation or combination thereof.

The two polymer components are selected from polyester or polyester based or any other fibre forming polymers. At least one of the components may be chemically modified to get differential performance attributes. One polymer component is poly (ethylene terephthalate) and the second polymer is selected from the group comprising faster crystallizing polyesters, such as, poly(butylene terephthalate) or poly(trimethylene terephthalate) or any other polyester or non-polyester fibre forming polymer.

The self-crimping high bulk yarns comprise one slow crystallizing component and second higher crystallizing component.

The intrinsic viscosity of slower crystallizing component is less than the intrinsic viscosity of faster crystallizing component, the intrinsic viscosity of faster crystallizing component being in the range of 0.55 to 1.15 and intrinsic viscosity of slower crystallizing component being in the range of 0.45 to 0.74.

The two polymer components are used in the ratio of 30:70 to 70:30. More specifically the ratio is in the range of 60:40 to 40:60 and preferably 50:50.

A cross section of the yarn is solid circular, solid trilobal, hollow circular, hollow trilobal, solid any other non-circular cross section or hollow any other non-circular cross section. The hollow circular cross section of the yarn enhances stretch and bulk attributes.

The method of producing the self-crimping fully drawn high bulk yarns of the invention is single stage process (FDY) or a two-stage process such as POY and texturing.

The present invention further discloses a method of producing the self-crimping fully drawn high bulk yarns comprising a single stage process consisting of extruding the two viscoelastic fiber forming polymer components in separate extruders through the pack towards the capillary to obtain circular or non-circular cross-section yarn; quenching the yarn, spinning the yarn at speed in the range of 1000 to 2500 meters per minute, passing the yarn over a pair of draw rollers heated between 60° C. to 180° C., drawing the yarn at speed in the range of 3300 to 5000 meters per minute and winding the yarn on bobbins.

The single stage process (FDY) comprises quenching the filaments as they leave out the capillary, drawing the filaments and heat setting simultaneously on hot draw rollers in the temperature range of 70 to 180° C. followed by winding on the bobbins at a speed of 3300 mpm to 5000 mpm to produce high bulk yarn.

The present invention further discloses a method of producing the self-crimping fully drawn high bulk yarns comprising a two stage process consisting of extruding the two viscoelastic fiber forming polymer components in separate extruders through the pack towards the capillary to obtain circular or non-circular cross-section yarn; quenching the yarn, passing the yarn over cold godets after suitable spin finish application, and are wound on the bobbins in the speed range of 2200 to 3500 mpm to produce a partially oriented yarn. (POY).

In the present method, the polymers may be directly fed from the outlet of the finisher vessel from the continuous polymerizer to the extruder.

In the present method, the partially oriented yarn is processed through false-twist texturing process in the range of 300 to 800 mpm take-up speeds.

In the present method, the yarn is processed by air texturing route by single end texturing or co-texturing methods.

In the present method, the yarn is twisted in 'S' or 'Z' direction in the range of 200 to 2700 turns per meter and heat set in the temperature range of 80° C. to 95° C. with or without use of vacuum in single or multiple cycles before further processing.

In the present method, the self-crimping yarn subjecting to wet or dry thermal treatment in the temperature range of 90° C. to 190° C. to enhance the crimp/stretch level in the yarn/fabric.

The self-crimping high bulk yarn is produced by the above mentioned method.

The self crimping high bulk yarns having characteristics crimp contraction levels are in the range of 5% to 52%.

The fabrics comprising the self-crimping high bulk yarn in the proportion range of 30% to 100%.

DETAILED DESCRIPTION

According to the present invention there are provided self-crimping fully drawn high bulk yarns comprising fibre forming bicomponent filaments comprising two polymers having different crystallizability or differential orientation or combination thereof.

The two polymers are selected from melt spinnable viscoelastic fiber forming polymers which are arranged in side-by-side relationship i.e. the two polymers are adhered in parallel to each other along the length of the filament.

The key concept of the invention is to exploit the difference in the crystallizability, and differential orientation due to viscosity difference of the two components for developing differential morphology leading to differential draw and shrinkage. The proportion of the two polymers (may not be equal) is constant along the length of the yarn. The two polymer components are selected from polyester or polyester based or any other fibre forming polymers. The primary viscoelastic fiber forming polymer component is selected from slow crystallizing polymer group such as poly(ethylene terephthalate) and the second component is selected from the family of fast-crystallizing polymers, for example, poly(butylene terephthalate), poly(trimethylene terephthalate) or any other fiber forming yet faster crystallizing polyester (based on chemical modification) or non-polyester viscoelastic polymeric component. The second fibre forming polymer component may be modified by using different chemistry, different additives, blends and alloys.

According to the present invention, the self-crimping effect can be accentuated by expanding the IV difference between the two polymers. The IV of the second component can be increased by carrying out a solid state polymerization to a level, which further widens the gap of crystallizability of the two components. In the present work, the IV of poly(trimethylene terephthalate) is increased from 0.92 to 1.15 in a batch solid state polymerizer. Alternatively the IV of the first component i.e. poly(ethylene terephthalate) can be reduced to a level wherein spinning can be possible yet giving increased difference melt viscosities enough to generate fine crimps in the yarn.

The intrinsic viscosity of slower crystallizing component is less than the intrinsic viscosity of faster crystallizing component, the intrinsic viscosity of faster crystallizing component being in the range of 0.55 to 1.15 and intrinsic viscosity of slower crystallizing component being in the range of 0.45 to 0.74.

According to the present invention, the proportion of the two polymer components is in the range of 30:70 to 70:30. More specifically the ratio is in the range of 60:40 to 40:60 and preferably 50:50.

A cross section of the yarn is solid circular, solid trilobal, hollow circular, hollow trilobal, solid any other non-circular cross section or hollow any other non-circular cross section. The hollow circular cross section of the yarn enhances stretch and bulk attributes.

According to present invention, the method of producing the self-crimping fully drawn high bulk yarns comprises extrusion of the two viscoelastic fiber forming polymer components in separate extruders or alternatively the polymers can be directly fed from the outlet of the finisher vessel from the continuous polymerizer, which travel independently from extruder through the pack towards the capillary. Here the two components meet each other as they enter the capillary, and are adhered in parallel with each other in side-by-side polymer arrangement in circular or non circular cross-section of the yarn; quenching the filaments as they leave the capillary and get on to the draw rollers.

The process consists of extruding the two polymers well above their melting temperatures wherein the two polymers are at different temperatures until they meet in the capillary.

The two polymers although in contact as they pass through the capillary, maintain their identity as two individual polymers.

In the present invention, the filaments are cooled by the cooling air as they leave the spinneret and are immediately drawn by the draw rollers. The spinning speed may be between 1000 to 2500 meters per minute. As the filaments are spun they are passed over a pair of draw rollers heated between 60° C. to 180° C. The level of the draw is between 1.5 to 3.5 depending on the speed and the polymer combination and their mass contribution in the filament cross section along the length of the yarn. The drawing speed may be between 3300 to 5000 meters per minute. As they are pulled, the filaments get drawn and heat-set on one set of rollers, followed by controlled relaxation prior to winding the yarns on bobbins.

According to the present invention, the level of crimp in the as-drawn yarn can also be manipulated by varying heat setting temperature. Increased heat set temperature gives both the polymers chance to crystallize and thus the delta crystallinity gets reduced. This will have negative impact on the crimps in the yarn. On the other hand, reduced heat set temperature will favor one polymer over other in terms of development of crystallinity, which will result into high crimps in the yarn and improved stretch in the fabric. The lower limit is defined by the processability of the yarn in subsequent processing sequences. The heat set temperature should be carefully selected after giving due importance to the variables such as IV of polymers, melt viscosity, spin temperatures etc. An optimum processing window for all the various polymer combination and titre of the resulting filaments can be defined.

In the present invention, the self-crimping effect achieved depends upon the differential rate of crystallization between the two polymeric components. The two polymers give different responses to the online heat treatment to which the filaments of the polymer are exposed while spinning and drawing at any particular speed, as they have different crystallization half times. When the yarn is drawn over the heated godets, oriented crystallization takes place. As the response of the two polymers (in combination) is different to the thermo-mechanical treatment posed by the orientation and heat of the draw rollers, both the fiber forming polymers will crystallize to different extent, thereby giving different morphological characteristics leading to differential shrinkage. The spinning and drawing processes are coupled and the fully drawn self-crimping yarns are produced in a single stage, which are ready yarns for getting into the fabric.

According to the invention, the extruded filaments were passed over cold godets instead of hot godets, and at lower speeds compared to the speeds at which fully drawn yarns are produced, but the speeds are significantly higher than spinning speeds of rollers employed in a single stage process. The POY spinning speeds are typically in between 2100 mpm to 3300 mpm.

In the invention it is disclosed that the two-stage process can also result into the comparable stretch when converted into the fabric form. The POY and texturing route will give additional feel and bulk into the yarn. POY is textured on a draw-texturing machine to impart additional bulk and feel effects. In this process the drawing and texturing takes place in a continuous mode. The texturing can be done on a false twist texturing machine where the POY is drawn between the two sets of rollers which are essentially cold and the yarn is heated as it passes over the heater located in between the two sets of rollers. The thermal response of two polymers in bicomponent yarn will be different because of their inherent differences in crystallizability. Between the two sets of rollers is also located set of friction discs and the yarn is passed in a zig-zag form around the texturing discs made up of ceramic or polyurethane materials. Drawing is carried out as the twist is imparted in the filaments, but the twist is taken out as the yarn leaves the discs. The yarn thus resulting will have a softer feel and improved bulk. Alternatively texturing can be accomplished by air texturing method to get feel and look of natural fibres. Other commonly known texturing methods (like gear crimping, belt texturing) can also be employed to get the desired effect.

In particular, the method of producing the self-crimping fully drawn high bulk yarns comprising extruding the two viscoelastic fiber forming polymer components in separate extruders through the pack towards the capillary to obtain circular or non-circular cross-section yarn; quenching the yarn, spinning the yarn at speed in the range of 1000 to 2500 meters per minute, passing the yarn over a pair of draw rollers heated between 60° C. to 180° C., drawing the yarn at speed in the range of 3300 to 5000 meters per minute and winding the yarn on bobbins.

The fibre forming polymeric components may be fed directly from finisher of the polymerization vessel or it may be fed to the extruder in the form of pellets.

The method of producing the self-crimping fully drawn yarns is a single stage process (FDY) or a two stage (POY and texturing).

The single stage process (FDY) comprises quenching the filaments as they leave out the capillary, drawing the filaments and heat setting simultaneously on hot draw rollers in the temperature range of 70 to 180° C. followed by winding on the bobbins at a speed of 3300 mpm to 5000 mpm to produce high bulk yarn.

The two stage process comprises passing the yarn over cold godets after suitable spin finish application, and are wound on the bobbins in the speed range of 2200 to 3500 mpm to produce a partially oriented yarn. (POY).

In the present method, the partially oriented yarn is processed through false-twist texturing process in the range of 300 to 800 mpm take-up speeds.

In the present method, the yarn is processed by air texturing route by single end texturing or co-texturing methods.

In the present method, the yarn is twisted in 'S' or 'Z' direction in the range of 200 to 2700 turns per meter and heat set in the temperature range of 80° C. to 95° C. with or without use of vacuum in single or multiple cycles before further processing.

In the present method, the self-crimping yarn subjecting to wet or dry thermal treatment in the temperature range of 90° C. to 190° C. to enhance the crimp/stretch level in the yarn/fabric.

The yarns are fully drawn yarns or textured yarns and may have circular or non-circular cross-section, such as trilobal. The fully drawn yarns have boil-off shrinkage levels in the range of 5% to 52%. The self-crimping yarns should have the crimp contraction levels of at atleast 12% to get good levels of stretch in fabric. These yarns have an Uster unevenness less than 2.0%. The unevenness may increase if the process conditions especially quench parameters are not set right, particularly in hollow cross section. The self-crimping characteristics may be further enhanced by subjecting the yarns to boiling water treatment.

The present invention also discloses the effect of twisting on stretch behaviour of the fabrics. The yarns produced either by single stage process or through two-stage process are twisted in the range of 200 turns per meter to 2700 turns per meter. They are then heat-set in a vacuum furnace in the temperature range of 80° C. to 95° C. for a period of 30 to 45 minutes. The stresses generated in the filaments due to twisting get relaxed during heat treatment. This avoids the snarling effect in the twisted yarns. The filaments with such mechanical and thermal history manifest into different kind of stretch in the fabric form. Moreover the effect can also be manipulated by varying the twist levels in the yarn. It is seen that higher twist levels give comparatively more stretch in the fabric form.

The crimps, which get developed in the spinning stage, are further enhanced by the heat treatment in boiling water. Thus the final crimp levels attained due to the differential draw in the spinning and then due to differential shrinkage in the boiling water (the same will also get further developed in the dyeing, processing stage etc.) can be manipulated by differential degree of crystallinity of the two polymers in the fully drawn state. For example, a yarn which has a shrinkage level of about 15% in the drawn yarn (FDY) will have crimps in the range of 238 crimps per meter, but when subjected to boiling water shrinkage treatment the crimp level gets enhanced to 1651 crimps per meter. This gives another tool to control crimp through differential shrinkage of the two polymers in consideration.

In one of the embodiment of the invention, out of the two polymers in consideration the primary polymer component is poly(ethylene terephthalate) and the second one is from the family of fast-crystallizing polymers, for example, poly(butylene terephthalate), poly(trimethylene terephthalate) or any other fiber forming yet faster crystallizing polyester or non-polyester polymeric component.

In another embodiment, the polymer components are poly (ethylene terephthalate) and poly(butylene terephthalate) components with no other chemical modifier employed, which are spun on a bicomponent spinning machine.

According to the present invention, the stretch or crimp level in the yarn gets accentuated when the fabric composed of such bicomponent yarns or the yarns themselves are exposed to thermal treatment. The thermal treatment can be a dry treatment such as processing on a 'stenter' or wet treatment such as scouring, dyeing etc. The bulk is evident in the drawn yarns, which further enhances after processing treatments due to differential shrinkage. Further, the bulk and shrinkage properties of the material can be manipulated independently to get the desired effect.

The other physical properties of the yarns are similar to the other commercially available yarns thus posing no hindrance in making the yarns commercially acceptable.

The yarns thus produced can be processed through normal fabric forming machines like loom (weaving), circular knitting, warp knitting etc.

The fabrics produced containing the self-crimping produced according to the invention comprising the bicomponent yarns in the proportion range of 30% to 100%.

The samples were tested as per the procedures listed herewith.

A. Crimp Contraction:

1. Make the 1500 denier hanks of yarn on reeling machine with pre-tention device having number of wraps as per following formula. No. of wraps calculated is to be converted in round figure for making hanks.

$$\text{No. of wraps} = \frac{300}{\text{Denier} \times 0.1 \times 2}$$

2. Put the hanks on the hanger and keep it in oven for approx. 20 min. at 120° C.
3. Take out hanks from the oven and keep at room temp. for conditioning for 30 minutes.
4. After conditioning, take L1 with tension weight (300 gm) along with pre-tension weight 3 gm.
5. Remove the tension weight 300 g. from the hanks and take L2 with pre-tension weight 3 gm.
6. The crimp contraction can be calculated from the following formula $$\text{Crimp contraction}(\%) = \frac{L1 - L2}{L1} \times 100$$

The crimp contraction will give a quantitative idea about the level of stretch in the fabric form if processed correctly and in particular weave combination. Meaningful comparison of the results can be made if the competitive products have similar count and number of filaments.

B. Boiling water shrinkage: A 2500 denier hank is prepared on a wrap reel of 100 cm circumference and its initial length (L1) is measured at a load of 50 g. After measuring the length 50 g load is removed at a pretension of $2.2\times10^{-3}$ g/denier is applied. All such hanks were arranged in series around the magazine. The magazine is dipped in boiling water and is kept for 20 minutes under wet heat treatment. After the treatment, the magazine is taken out and the filaments are allowed to cool. Then the hanks are measured for length with a pretension of 50 g after heat treatment (L2). The change in length, expressed in percentage gives the shrinkage.

C. Crimps per unit length: The test is carried out on a single filament in which a continuous filament is cut into a small segment of about 50-mm length. The filament is held in two jaws while the distance between the jaws is 30 mm. The numbers of nodes are counted, as the filament is slack between the jaws. After counting the same the right jaw is moved till the crimps straightened out. Exact final length is measured and normalized for unit cm and results are expressed in crimps/cm.

Thus the self-crimping fully drawn high bulk yarns comprising bicomponent filaments, which manifest self-crimping characteristics in as-drawn yarns. These yarns can be directly sent on the machines producing fabrics optionally after converting the bobbins into beam form. The yarns can also be twisted and heat set before converting into beam form as a separate unit operation in fabric-forming process. This stage is routinely followed for normal polyester or blend yarns. There are two advantages of this product, namely, the expensive intermediate draw-texturing step is eliminated, and secondly latent crimp is produced in the filaments, which can be exploited to get the stretch effect. The shrinkage and the bulk can be independently controlled, so that the product specifications can be tailored to get the desired effect.

The present invention is further exemplified by the following non-limiting examples of the self-crimping fully drawn high bulk yarns and their physical properties.

EXAMPLE 1

Self-crimping bicomponent yarns of 75 denier, 36 filaments are produced on a M/s. Hills bicomponent extrusion system. Poly(ethylene terephthalate) and poly(butylene terephthalate) of IV 0.62 and 1.15 were melted separately in separate extruders and were extruded through a spin pack designed by M/s. Hills. Poly(butylene terephthalate) was supplied by DuPont.

The plates in the pack are arranged so as to configure the polymer flow into a side-by-side fashion. The spin block is heated to 285° C. The polymers meet only in the capillary in a side-by-side fashion and are extruded together. The bundles of filaments get cooled down as they come in contact with quenching media i.e. air. The yarns were passed over heated godets after a suitable spin finish is applied onto it. The filaments first come into contact with a heated godet roll which is heated at a temperature of 80° C., taking certain number of wraps onto it and then passing over second godet roller, which is also heated at a temperature of 120° C. The filaments are drawn at a speed differential ratio of 2.80. The yarns are drawn at a speed of at least 3800 meters/min. at a draw of at least 2.50. The yarns are heat set on the draw rollers and are wound on bobbins at a speed of 3800 meters per minute. This process has resulted into 13% shrinkage, 12% crimp contraction, 3.99 gpd tenacity and 30% elongation.

EXAMPLES 2-4

The yarns are produced as per the set up described in Example 1 for getting 150 denier 36 filament bundles which are drawn at 4200 meters/min. at a draw of at 2.50. The yarns are heat set on the draw rollers at a temperature of 150° C. and are wound on the bobbins.

Example 2: Heat set at 150° C.

Example 3: Heat set at 140° C.; other conditions remaining the same.

Example 4: Heat set at 130° C.; other conditions remaining the same.

The shrinkage values are the following:

TABLE 1

Shrinkage Vs. Heat set temperature

| Example | Heat set temperature (° C.) | Shrinkage (%) |
|---|---|---|
| 2 | 150 | 25.0 |
| 3 | 140 | 27.0 |
| 4 | 130 | 28.0 |

The crimp contraction is in the range of 20% to 26%, when processed in this set temperature range.

EXAMPLE 5

Poly(butylene terephthalate) and poly(ethylene terephthalate) were extruded through a spinpack composed of plates that will configure the two polymer streams into a side-by-side bicomponent geometry. The spinneret used was a hollow one. This combination will give side-by-side bicomponent filaments with a hollow cross section.

A 150 denier 72 filament fully drawn yarn is produced at a spinning speed of 2288 mpm and a draw of 1.7 is maintained between the draw rollers. The set temperature was maintained at 125° C.

This set of process conditions resulted in a shrinkage level of 24% and a crimp contraction of 23%. Hollow fibres will have more contracting force between the polymer components thus resulting into higher shrinkage values, which in turn will manifest into higher stretch levels in the fabric.

EXAMPLE 6

Poly(trimethylene terephthalate) and poly(ethylene terephthalate) were melted in separate extruders and passed through pack assembly at sufficient pressure so as to configure into a side-by-side bicomponent filaments when extruded. The IV of the polymers were 0.92 and 0.62 respectively. The filaments were threaded over draw roll system to produce a fully drawn yarn. The draw roll was heated to 80° C. and drawn at 2.83 times the original length so as to result into self-crimping high bulk yarns. The bicomponent yarn thus produced will have 17% shrinkage and 16% crimp contraction.

EXAMPLE 7

Poly(trimethylene terephthalate) and poly(ethylene terephthalate) of intrinsic viscosity 0.45 and 0.92 respectively melted and extruded together through the system described in the preceding examples. The filaments were threaded over draw roll system to produce a fully drawn yarn. The filaments were heat-set at 120° C. and drawn at 3.2 times the original length so as to result into self-crimping high bulk yarns. The bicomponent yarn thus produced will have 40% shrinkage and 39% crimp contraction and will result into proportional stretch levels in the processed fabric.

EXAMPLE 8

The set up according to example 7 but the IV of poly (trimethylene terephthalate) is increased by carrying out solid state polymerization of 0.92 IV pallets. The IV of poly(ethylene terephthalate) was 0.45.

The PTT pallets with increased viscosity are again dried to reduce the moisture level and then extruded on one of the two extruders and then spun on Hills bicomponent spinning system to produce high bulk self-crimping yarns.

The shrinkage level with this set up is 46% at a crimp contraction of 51%, which is comparable to those produced by post extrusion coalescence system.

EXAMPLE 9

The bicomponent melt spinning system as described in above examples is used to produce a POY made up of poly (ethylene terephthaalte) and poly(butylene terephthalate) arranged in the side-by-side geometry. The filaments are passed over cold godets and wound over the bobbins. The bicomponent filaments were spun at 2400 meters per minute to get an elongation level of 125% in POY. The POY is draw textured on a SDS-700 false twist texturing machine to produce 80 den/36 fil set yarn. The textured yarn thus produced had 23% shrinkage and 22% crimp contraction.

EXAMPLE 10

The POY produced according to example 9 is processed on a DIGITONE precifex RM3T air texturing machine. The type of air texturing was of a parallel type. Two strands of 130/36 POY were taken together on air texturing machine and were processed at 300 meters per minute. The resultant yarn is a stretch yarn with look and feel of natural fibres.

We claim:

1. Self-crimping fully drawn high bulk yarns comprising fibre forming bicomponent filaments comprising two polymers having different crystallizability or differential orientation or combination thereof, wherein the yarns have crimp contraction levels in the range of 5% to 52% and a boil-off shrinkage of 5% to 52%.

2. The self-crimping yarns as claimed in claim 1, wherein the two polymer components are selected from polyester or polyester based or any other fibre forming polymers.

3. The self-crimping yarns as claimed in claim 1, wherein at least one of the components may be chemically modified to get differential performance attributes.

4. The self-crimping yarns as claimed in claim 1, wherein one polymer component is selected from the group comprising slower crystallizing polyester, such as, poly (ethylene terephthalate) and the second polymer is selected from the group comprising faster crystallizing polyesters, such as, poly(butylene terephthalate) or poly(trimethylene terephthalate) or any other polyester or non-polyester fibre forming polymer.

5. The self-crimping fully drawn yarn as claimed in claim 1, wherein the intrinsic viscosity of slower crystallizing component is less than the intrinsic viscosity of faster crystallizing component, the intrinsic viscosity of faster crystallizing component being in the range of 0.55 to 1.15 and intrinsic viscosity of slower crystallizing component being in the range of 0.45 to 0.74.

6. The self-crimping yarn as claimed in claim 1, wherein the two polymer components are used in the ratio of 30:70 to 70:30.

7. The self-crimping yarns as claimed in claim 1, wherein a cross section of the yarn is solid circular, solid trilobal, hollow circular, hollow trilobal, solid any other non-circular cross section or hollow any other non-circular cross section.

8. The self-crimping yarn as claimed in claim 1 produced by a single stage process consisting of: extruding the two viscoelastic fiber forming polymer components in separate extruders through the pack towards the capillary to obtain circular or non-circular cross-section yarn; quenching the yarn, spinning the yarn at speed in the range of 1000 to 2500 meters per minute, passing the yarn over a pair of draw rollers heated between 60° C. to 180° C., drawing the yarn at speed in the range of 3300 to 5000 meters per minute and winding the yarn on bobbins.

9. The self-crimping high bulk yarns as claimed in claim 1 produced by a two stage process consisting of extruding the two viscoelastic fiber forming polymer components in separate extruders through the pack towards the capillary to obtain circular or non-circular cross-section yarn; quenching the yarn, passing the yarn over cold godets after suitable spin finish application, and are wound on the bobbins in the speed range of 2200 to 3500 mpm to produce a partially oriented yarn (POY).

10. Fabrics produced from the self-crimping high bulk yarns as claimed in claim 1, comprises the bicomponent yarns in the proportion range of 30% to 100%.

* * * * *